US009114270B2

(12) United States Patent
Aldridge et al.

(10) Patent No.: US 9,114,270 B2
(45) Date of Patent: Aug. 25, 2015

(54) RANGE OF MOTION FLEXIBILITY DEVICE AND METHOD OF USE

(75) Inventors: Robert Aldridge, Novato, CA (US); Shari Aldridge, Novato, CA (US)

(73) Assignee: BAM MOTION, LLC, Novato, CA (US)

( * ) Notice: Subject to any disclaimer, the term of this patent is extended or adjusted under 35 U.S.C. 154(b) by 162 days.

(21) Appl. No.: 13/528,779

(22) Filed: Jun. 20, 2012

(65) Prior Publication Data

US 2013/0345032 A1 Dec. 26, 2013

(51) Int. Cl.

| | |
|---|---|
| ***A63B 21/00*** | (2006.01) |
| ***A63B 21/002*** | (2006.01) |
| ***A61H 1/02*** | (2006.01) |

(52) U.S. Cl.

CPC ..... *A63B 21/00* (2013.01); *A61H 1/0237* (2013.01); *A61H 1/0274* (2013.01); *A61H 1/0292* (2013.01); *A61H 2201/1253* (2013.01); *A61H 2201/1284* (2013.01); *A61H 2201/164* (2013.01); *A61H 2201/1621* (2013.01); *A61H 2201/1635* (2013.01); *A61H 2201/1652* (2013.01)

(58) Field of Classification Search

CPC ..... A63B 21/00; A63B 21/00058; A63B 21/00185; A63B 21/02; A63B 21/055; A63B 21/0552; A63B 21/0555; A63B 21/0557

USPC ..... 482/91–92, 121–126, 131

See application file for complete search history.

(56) References Cited

U.S. PATENT DOCUMENTS

| | | | | | |
|---|---|---|---|---|---|
| 324,498 | A | * | 8/1885 | Surbaugh | 601/45 |
| 579,818 | A | * | 3/1897 | Cooley | 297/468 |
| 1,551,932 | A | * | 9/1925 | Carver | 297/466 |
| 1,663,641 | A | | 3/1928 | Smallwood | |
| 2,212,746 | A | * | 8/1940 | Nunn | 119/770 |
| 3,999,752 | A | * | 12/1976 | Kupperman et al. | 482/131 |
| 4,010,744 | A | * | 3/1977 | Boyen | 602/36 |
| 4,220,328 | A | * | 9/1980 | Crush, Jr. | 482/92 |
| 4,273,327 | A | * | 6/1981 | Nall et al. | 482/71 |
| 4,456,249 | A | * | 6/1984 | Calabrese | 482/124 |

(Continued)

FOREIGN PATENT DOCUMENTS

JP 2009/219659 A 10/2009

OTHER PUBLICATIONS

International Search Report, mailing date of Oct. 11, 2013, for corresponding International Application No. PCT/US2013/046915.

(Continued)

*Primary Examiner* — Stephen Crow
*Assistant Examiner* — Garrett Atkinson
(74) *Attorney, Agent, or Firm* — Intellectual Property Law Group LLP

(57) ABSTRACT

A stretching device comprises a shoulder or body harness with an adjustable central hold arranged around the upper body connected with an adjustable extension strap configured to engage a foot at a distal end. The extension strap is slidably connected to the central strap to move along the length of the central strap. The wearable device and method of using the device provides a comfortable tension and facilitates hands free stretching in the supine position, for improving duration of the stretching and range of motion. The device straps may be quickly disassembled with a strap independently used, or in a combination rearranged for connection by interlocking the central strap with either a shoulder strap or the extension strap, for upper body and shoulder stretching.

17 Claims, 4 Drawing Sheets

(56) References Cited

U.S. PATENT DOCUMENTS

| | | | | | |
|---|---|---|---|---|---|
| 4,588,186 | A | * | 5/1986 | Calabrese | 482/131 |
| 4,667,624 | A | * | 5/1987 | Smith | 119/770 |
| 5,069,449 | A | * | 12/1991 | Wardwell | 482/13 |
| 5,207,627 | A | | 5/1993 | Doran | |
| 5,258,017 | A | * | 11/1993 | Myers et al. | 606/241 |
| 5,308,305 | A | | 5/1994 | Romney | |
| D358,625 | S | * | 5/1995 | Enriquez, Jr. | D21/686 |
| 5,518,486 | A | * | 5/1996 | Sheeler | 482/131 |
| 5,595,559 | A | * | 1/1997 | Viel | 482/91 |
| 5,704,856 | A | * | 1/1998 | Morse | 473/422 |
| 5,813,955 | A | | 9/1998 | Gutkowski et al. | |
| 6,299,569 | B1 | * | 10/2001 | Rich | 482/123 |
| 6,840,894 | B2 | * | 1/2005 | Lerner | 482/124 |
| 6,921,354 | B1 | * | 7/2005 | Shifferaw | 482/91 |
| 7,223,212 | B2 | * | 5/2007 | DiOrio et al. | 482/83 |
| 7,318,810 | B1 | | 1/2008 | Benson | |
| 7,384,382 | B2 | * | 6/2008 | Farrah et al. | 482/124 |
| 7,438,653 | B2 | * | 10/2008 | Anderson | 473/458 |
| 7,467,604 | B1 | * | 12/2008 | Werner et al. | 119/770 |
| 7,608,026 | B1 | * | 10/2009 | Nicassio | 482/124 |
| 7,749,141 | B2 | * | 7/2010 | Meisterling | 482/121 |
| 8,282,536 | B2 | * | 10/2012 | Latronica | 482/121 |
| D694,414 | S | * | 11/2013 | Sparkes | D24/190 |
| 2004/0152569 | A1 | | 8/2004 | Lerner | |
| 2005/0085350 | A1 | * | 4/2005 | Shen | 482/91 |
| 2006/0124162 | A1 | * | 6/2006 | Sweeney | 135/65 |
| 2007/0173382 | A1 | * | 7/2007 | Axelrod | 482/91 |
| 2008/0076645 | A1 | | 3/2008 | Brown | |
| 2008/0287274 | A1 | | 11/2008 | Koch | |
| 2010/0285939 | A1 | | 11/2010 | Latronica | |
| 2012/0035027 | A1 | | 2/2012 | Richardson | |
| 2012/0053027 | A1 | | 3/2012 | Hetrick | |

OTHER PUBLICATIONS

Written Opinion of the International Searching Authority, mailing date of Oct. 11, 2013, for corresponding International Application No. PCT/US2013/046915.

* cited by examiner

RANGE OF MOTION FLEXIBILITY DEVICE AND METHOD OF USE

FIELD OF INVENTION

This invention relates to a device and method to aid in stretching the body. More particularly, the invention relates to a wearable and hands free stretching device for improving body flexibility and range of motion.

BACKGROUND

Stretching is an integral part of proper exercise or fitness routine. It is further an essential component of physical therapy and sports medicine. Stretching reduces tissue injury, improves flexibility, helping joints move through their full range of motion and increases blood flow to muscles. Those who regularly work out including athletes understand the benefits of stretching and improving body flexibility as well as range of motion during exercise programs and to perform certain elements during competitive routines. For anyone engaging in physical activity, stretching has long been recommended in warm up and cool down regimens. Various methods are used for stretching. Some methods involve stretching without any device by using one's own body or applying tension on an external stationary object, while some methods involve use of an apparatus. Stretching should be performed slowly and steadily, in a controlled manner, to reduce injuries such as muscle or ligament tearing. Stretching should also be performed for required duration to prevent tissue injury and improve flexibility.

Some existing methods and devices for stretching do not maximize the benefits of appropriate stretching and can actually cause side effects due to improper form and misalignment of the body. Some stretching devices for targeted leg and back stretching require the use of arms to hold onto a device, thereby putting unnecessary strain on the person especially discomfort in the upper body. Such devices as yoga straps further are not connected to or supported by the body and thereby lead to often cumbersome, awkward, uncomfortable or inefficient hand guiding. Some devices require the use of an external stationary object to connect the device to create the necessary tension, thereby making the convenience of using such a device a problem. Such use of external objects or the user's hands to create tension results in difficulty in use, shorter duration of the stretching, limited range of motion and may compromise safety.

Accordingly, the need for a stretching device and method that can minimize side effects of such inappropriate and inconvenient stretching is apparent. At the same time, there is a need to maximize benefits of efficient stretching by improving duration and range of motion through comfortable, hands free stretching, while maintaining safety and productivity.

SUMMARY

Some embodiments of the present invention satisfy these needs. Some embodiments of the present invention include a novel hands free stretching device that is wearable. In an embodiment, the device comprises a body harness with arm or shoulder holds.

One object of the present invention is to provide comfortable tension. Another object of some embodiments of the present invention is hands free stretching which the user is in the supine position, allowing for a relaxed upper body and comfortable movement of an extension leg strap including the side-to-side direction without interfering with the position of the harness.

Still another object of some embodiments of the present invention is to allow upper body stretching since hands are not required to hold any part of the device.

A related object is to allow a user to stretch for longer duration of time by providing maximum comfort during the stretching process. As an aspect of the invention allows the user to stretch hands free in the supine position, the device further encourages people of all ages to productively stretch for a relaxing and longer pace.

The above objects are accomplished, for example, by providing a device comprising a body harness including one or more straps made of flexible, non-elastic material to create comfortable tension.

The above objects are accomplished, for example, by providing a shoulder harness that fits snugly over upper torso for hands free stretching. The body harness includes at least one shoulder support hold and an adjustable central torso hold for arranging around an upper torso of the body; and at least one adjustable extension strap having a first end and a second end, the first end slidably attached to the body harness to move continuously along the transverse length of the body harness, and the second end forming an appendage support, such as a loop. In another embodiment, the extension strap further comprises a strap adjuster, wherein the first end secured to the front of the harness and the second end positioned through the strap adjuster to form an adjustable distal loop.

The objects are further accomplished, for example, by providing a slidable guide segment attached to the extension strap at one end and from the other end to the harness along a length of the central hold. The movable guide segment allows the extension strap(s) to move/glide freely around the upper torso to allow full range of motion, side to side stretching.

One embodiment of the present invention is use of flexible but non-elastic material to create comfortable tension. According to embodiments of the present invention, the strap components are comprised of woven fabric such as cotton or synthetic material webbing.

One embodiment of the present invention is use of an O ring for the movable segment. Another embodiment of the present invention comprises the device using hooks similar to a carabiner or mountaineering hooks. Another embodiment of the present invention is use of a clip. Another embodiment of the present invention is use of a loop slidable around the central strap sewn from the connecting end of the adjustable strap around the central strap.

Another embodiment of the present invention is use of additional smaller movable straps connected to the central strap as hand straps similar to leg straps but of shorter length for stretching the upper body. In one aspect, the device components may be disassembled such as the central hold from a shoulder strap or extension strap, with two of the straps locked through one another for upper body, shoulder/arm stretching. In an alternative aspect, one of the straps such as the extension strap itself is disconnected and adjusted to be long enough to conduct the shoulder/arm stretching.

Another embodiment of the present invention is use of detachable connectors to connect additional smaller movable straps to the central strap. The extension strap may include a strap adjuster and or a buckle connection for disconnecting the distal end of the extension strap from the extension strap. Similarly the harness including the central hold as well as one or more of the shoulder holds may include a strap adjuster and connection assembly for easy removal and adjustability of the straps.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
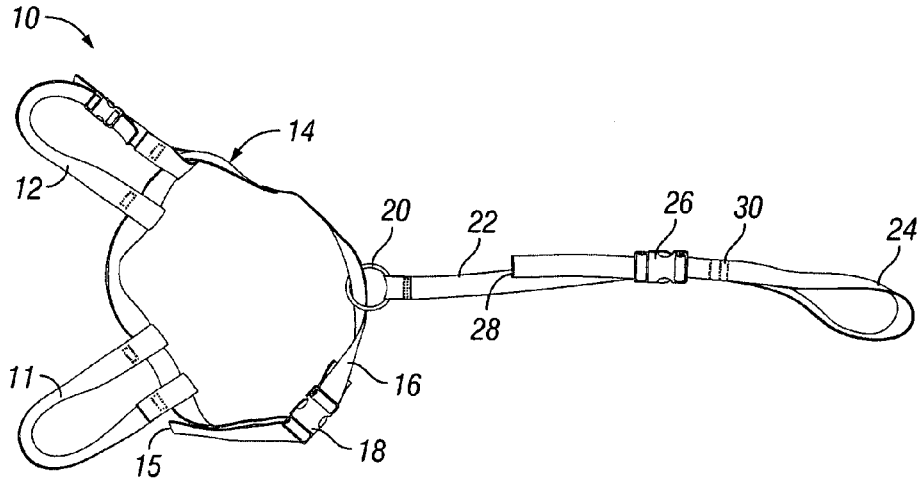
FIG. 1 is a view of the device in assembled form in accordance with an embodiment of the present invention.

An embodiment of the present invention is a range of motion flexibility device as illustrated in FIG. 1. The device 10 comprises a shoulder or body harness 14 with a central hold or strap 13 arranged around the upper torso; a movable segment 20 attached to an adjustable extension strap 22 with a distal end appendage support such as loop 24. The movable segment 20 is attached to the extension strap 22 with a first end secured around the movable segment 20, for example the first end sewn upon itself at a point 21. The central hold 13 is provided with a connector assembly 18 for easy removal. The body harness 14 comprises at least one shoulder hold and in an embodiment, two shoulder holds 11, 12 to keep the device balanced and comfortably snug in place during the stretching motion.

According to an embodiment, as shown in FIG. 1, the adjustable extension strap 22 comprises a distal loop 24 which may formed by securing an end of the extension strap onto itself. In an embodiment, the loop 24 is sewn upon itself at point 30. The loop 24 serves as an appendage support, foothold, during the stretching motion. The extension strap 22 further comprises a connector assembly 26 which may further serve as a strap adjuster.

The device 10 can be made of various materials. Flexible, non-elastic materials forming a strong yet lightweight woven material is a desired for the strap components. Such woven material may include a woven fabric, including cotton or flax, as well as synthetic materials including vinyl or polymer materials. The straps may be manufactured as a cotton or canvas webbing, as well as synthetic webbing including nylon, polypropylene, polyester and blends thereof.

In one preferred embodiment, the device strap components are made of flexible and strong canvas strap such as a typical yoga strap. In another preferred embodiment the strap is made of lightweight polypropylene.

Figure 2:
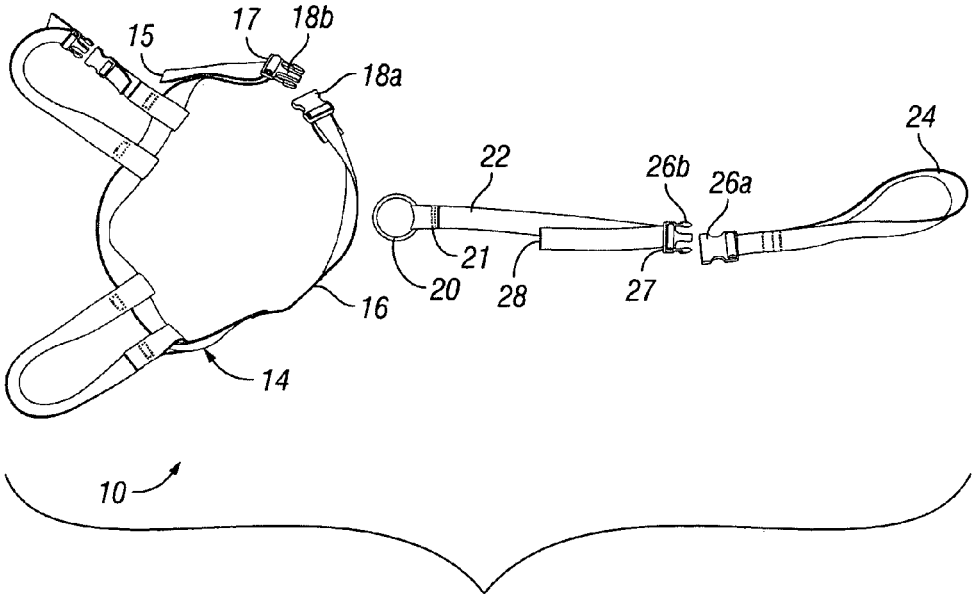
FIG. 2 shows a view of the device in a disassembled form according to an embodiment of the present invention.

As shown in FIG. 2 the device 10 is shown in a disassembled or disconnected position in which the harness connection assembly 18 is in the open position. In an embodiment, connector assembly 18 is made of a snap buckle for easy removal showing a receiving end 18*a* and an insertion end 18*b*. In an embodiment, the connector assembly 18 is connected to a first end of the central strap 13 at the receiving end 18*a* and to a second end 15 at the insertion end 18*b* in which the second end 15 is pulled through the strap adjuster 17 on the insertion end 18*b* of the buckle 18. The first end may further be secured upon itself at the receiving end 18*a* or also engaged through a respective strap adjuster.

Due to the ability to conveniently and quickly disassemble the harness structure, the central hold 13 of the harness 14 may be rearranged to position the connector assembly on a different side or location of the body. For example, FIG. 2 shows the central hold 13 of the harness 14 arranged in opposite fashion from that in FIG. 1, such that the connector assembly 18 is on a different side.

As further illustrated in FIG. 2, the extension strap 22 may be disconnected from the end loop 24 at the connector assembly 26. The end loop 24 is securely attached a receiving end 26*a* of the connector assembly 26. The extension strap length is made adjustable through the strap adjuster 27 at one side of the connector assembly 26, such as at the insertion end 26*b*, by threading an extension strap end 28 through the adjuster 27. The strap adjuster 27 may further be a separate component from the connector assembly 26.

In an embodiment, the connector assemblies 18, 26 comprise a buckle connection. The connector assemblies may be selected from a group consisting of, but not limited to, clasps, fasteners and buckles including side release buckles, center release buckles, cam and spring buckles or ratchet buckles. The material used for the connector assemblies 18, 26 including connected or separate strap adjusters, may be selected from plastic hardware or metal hardware.

According to an embodiment, the movable segment 20 is made of an O ring for easy gliding on the central strap 13 to allow side to side movement of legs and arms to allow range of motion stretching. The movable segment 20, in a preferred embodiment, is attached to the central hold 13 or harness component with a quick release mechanism. The movable segment 20 may comprise in other embodiments, of a slidable means including rings, D rings, loops, hooks such mountaineering hooks, snap hooks, carabiners, springlinks, or clips, for easy gliding on the central strap to allow side to side movement of legs allow a full range of motion stretching.

In another embodiment, the movable segment 20 is made of a loop formed by the end of the extension strap 22 secured upon itself, to connect with the central strap 13 for easy gliding on the central strap to allow side to side movement of legs and arms to allow range of motion stretching.

According to an embodiment, the central hold 13 is integrated with a low friction front portion 16 along which the movable segment 20 easily glides along the transverse plane of the body. The low friction portion 16 may comprise the same or different material as used throughout the harness. In an embodiment, the central hold 13 includes an overlapping outward facing guide cable resting along the central hold 13. The extension strap 22 may be directly engaged upon the guide cable for slidably moving along the guide cable in front of the central strap 13 such that the guide cable does not interfere with the harness 14 during movement. Importantly, the extension strap 22 is engaged with the front of the harness 14, for example with the low friction portion 16 of the central hold 13, for a continuous sliding motion, allowing for hands free, secure and aligned back stretching. The harness 14 including the central hold 13 is adjustable to fit various chest sizes of users.

In a related embodiment, the central hold 13 is placed as a portion in front of an inner strap or wearable section such that the central hold 13 overlaps the inner strap. Both the inner strap and the central hold 13 are made conveniently adjustable to accommodate different chest dimensions/diameters of users of various sizes.

According to an embodiment, the adjustable extension strap 22 is formed of one continuous loop connected by a strap adjuster. In this embodiment, the top of the loop is attached to the central hold 13/front portion 16 while the bottom of the loop serves as the appendage support 24 is where the foot is positioned. In this embodiment, the appendage support 24 is not detachable from the extension strap 22. In an embodiment, the appendage support 24 is configured with a thicker or wider portion at a point where the foot is in contact with the support so as to better grip the bottom of the foot or to improve ergonomic feel.

In some embodiments, some of all of the harness 14 may comprise of a sturdy yet lightweight padded material for added comfort. The harness may be constructed to have only a single shoulder hold or crossover hold providing resting over at least one shoulder to provide necessary resistance on the central hold 13 from pulling downward toward the waist. In another embodiment, a criss-cross over the shoulder configuration may be implemented for the harness, either crossing in the front or the back of the body. In another embodiment, the harness may include a flexible, wearable vest such that the straps lay over or are incorporated into the vest material.

In yet another embodiment, each of the shoulder holds 11, 12 of the harness 14 may both or either comprise a length adjuster. The length adjuster providing for the shoulder holds to fit around different sized users and to facilitate easier removal of the device. In a further embodiment, the shoulder holds may be configured for a connection with the central hold 13 such that the shoulder hold is formed of two free ends connected by a connection assembly, such as a quick release buckle connection with a strap adjuster, positioned to lay on top of the shoulder of in front of the chest in the connected position. This configuration allows for each removal and access in and out of the harness 14, as well as adjustability for different sizes of user bodies. In a further embodiment, either or both shoulder holds 11, 12 may be configured to form a continuous strap looped to wrap around the central hold 13 strap, with the free ends of the shoulder hold strap connectable by a connection assembly, such as a quick release buckle connection. In such a construct, the ends of the shoulder hold are freely adjustably by a strap adjuster at the connection ends, similar to the adjustable connection 17 on the central hold 13. The connection assembly may lay comfortably on the top of the shoulders or at a position in front of the body for easy access. In this configuration, the shoulder hold may be released and easily removed from the central hold 13.

In embodiments of the present invention, the material used for the harness comprise of lightweight, flexible yet durable material which can sustain the rigors and tension applied by large and strong athletes for continuous and extended periods of time. The harness and the strap components may comprise of comfortable, breathable or moisture wicking materials or fabrics commonly used in sportswear, activewear or performance wear. Components in direct contact with the body may comprise of hi-tech fabrics with the aim of moisture control and keeping the body cool by moving perspiration away from the skin. Other components, connectors, hardware, as well as the straps of the device may comprise of lightweight yet sturdy elements to withstand large forces applied by a user, as routinely used in fitness and sporting equipment.

Figure 3:
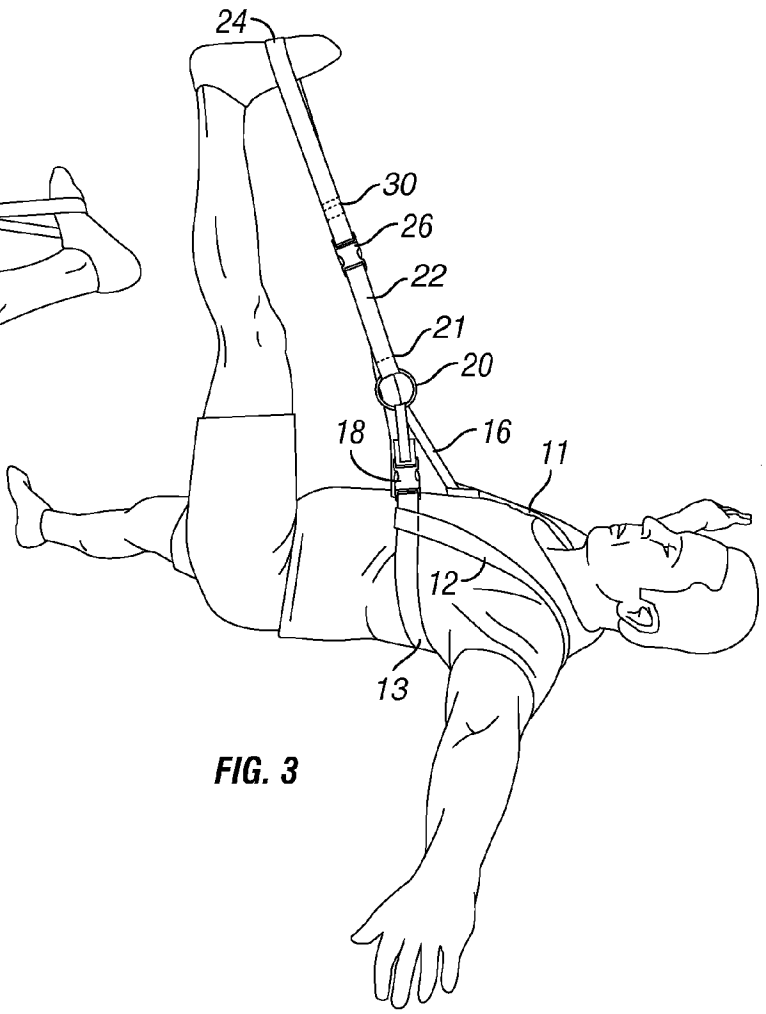
FIG. 3 illustrates the device in use as worn by a person for stretching, according to an embodiment of the present invention.
Figure 4:
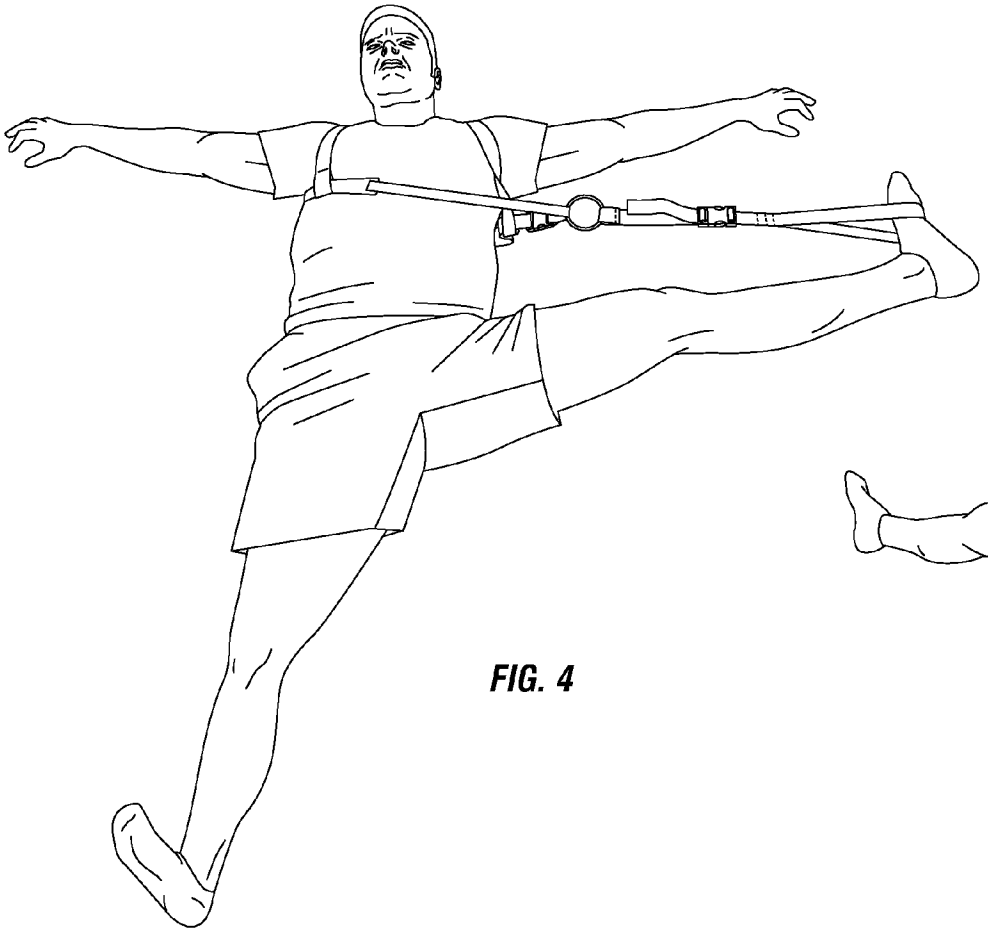
FIG. 4 illustrates the device in use as worn by a person in another stretching position, according to an embodiment of the present invention.
Figure 5:
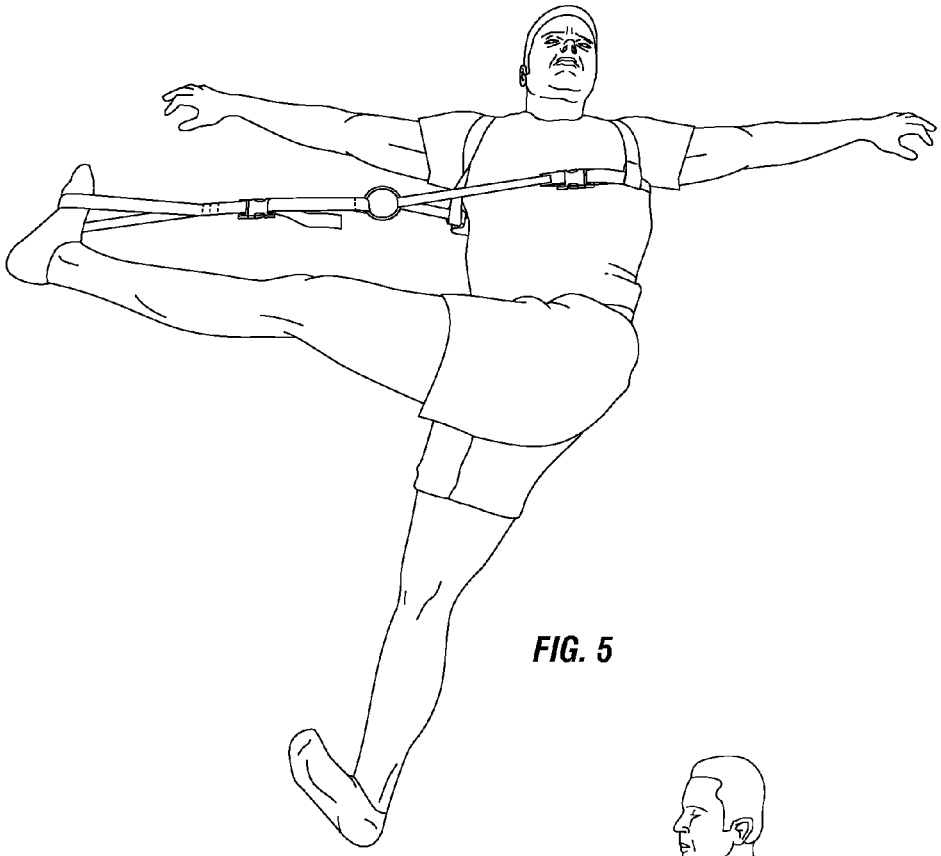
FIG. 5 illustrates the device in use as worn by a person in another stretching position, according to an embodiment of the present invention.

FIGS. 3 to 5 illustrate the use of the device 10 for hands free stretching in a variety of positions. According to an embodiment, the method of using the device comprises arranging the harness over at least one shoulder and the central strap around an upper torso of the body, placing a foot into the appendage support 24 formed at the second end of the extension strap. The extension strap length is adjusted to a desired length for stretching and tension by the leg/foot is applied against the support 24 to perform the hands free stretching. As shown in FIG. 3, the device is conveniently used when in a supine position as the user maintains the extension strap 22 taut while rotating the leg to move the extension strap 22 along the central strap/front portion 13, 16. The user wears the harness through one or more shoulder holds 11, 12, and adjusts the harness around the torso at the buckle connection 18. The extension strap 22 is adjusted at the connection 26 to the desired length and is freely moved along the front of the harness 14 at the low friction portion 16 via the movable segment 20.

In an embodiment, the extension strap 22 comprises incremental markings to measure the length of the strap as it is pulled or loosened to accommodate the length of the leg or to increase flexibility. For example, the portion which is pulled through the adjuster 27 between the strap end 28 and the adjuster 27 may be marked in half-inch increments to indicate the length of the strap 22. In an embodiment, the portion of the strap marked may be indicated at a base thirty inches and then shortened as flexibility improves or depending on height of the user. A user can improve and track flexibility with the measurement markings. As a user's flexibility increases, the increase of strap length pulled through the adjuster 27 will indicate progress. The markings can further be an easy indication at which to set the strap 22 length so that different users may interchangeably use the device and set the length quickly to the desired length.

FIG. 4 and FIG. 5 show two positions of using the device 10 for stretching the adductor and the abductor of the leg respectively, according to embodiments of the invention. The positions allow for a full stretch of the inner/outer thigh and groin regions. In addition, the hips and back benefit from a proper stretch. As shown, a full range of motion is achieved without the use of hands, while keeping the shoulders flat against the floor and back aligned, resulting in a comfortable stretch, which can be maintained for a longer duration. The continuity of the motion is further made possible by the harness structure and the movable segment along the central strap. The tension of pulling against the device is balanced by the harness and avoids constant adjustment of the strap or use of hands for positioning which are major drawbacks of existing exercise straps.

In using the device in the supine position, the user may further effectively and for longer duration stretch the iliotibial band (IT band) and hip flexors of each side of the body. The IT band extends from the hipbone toward the knee. The IT band attaches to the gluteal muscles as well as the TSL (tensor fascia latae) which is the muscle on the outside of the hip that moves the leg outward. As shown in the supine position of FIG. 3, the user may additionally extend the right arm to lay flat upward above the head while moving the extended left leg at an angle toward the right shoulder. Similarly, to stretch the IT band on the left side of the body, raise the left arm to lay flat upward above the head while moving the extended right leg at an angle toward the left shoulder. The device thereby provides a conveniently stable and comfortable position to facilitate stretching for extended period of time of various parts of the body.

According to another embodiment, the device components may be disassembled and reassembled with two of the straps locked through one another for upper body, shoulder/arm stretching. For example, interlocking the central hold 13 with any of the shoulder straps 11, 12 or the extension strap 22 or the foothold 24 for example. The foothold 24 therefore can serve as a handhold. In an alternative embodiment, one of the straps, such as the extension strap 22 itself, is disconnected and adjusted to be long enough to conduct the shoulder/arm stretching. The measured markings on the extension strap 22 can thereby be further used to incrementally decrease the length of the strap to increase the intensity of the stretching session or to mark off the size of the user's wingspan for future use. As shown in FIGS. 6-11, a number of upper body, back and shoulder exercises and stretches may be conducted with the device 10 using one of the disconnected straps or with two or more straps as interlocked, thereby further increasing range of motion and flexibility of the body.

Figure 6:
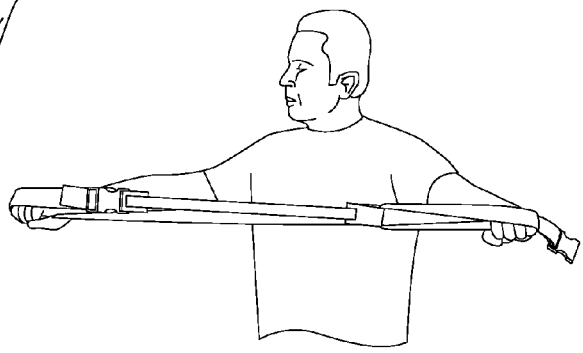
FIG. 6 illustrates the device in use as worn by a person in a shoulder/upper body forward stretching position, according to an embodiment of the present invention.
Figure 7:
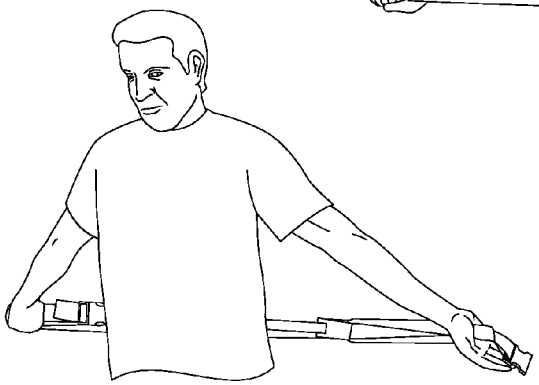
FIG. 7 illustrates the device in use as worn by a person in a backward shoulder/upper body stretching position, according to an embodiment of the present invention.

More particularly, FIG. 6 and FIG. 7 illustrate the device straps interlocked and used in a front and back, over the head motion. The arms are kept straight with elbows locked throughout the range of motion. The motion is repeated from the front over the head to the back and then from the back over the head to touch the front of the body. The device is adjustable to accommodate the arm span of the user.

Figure 8:
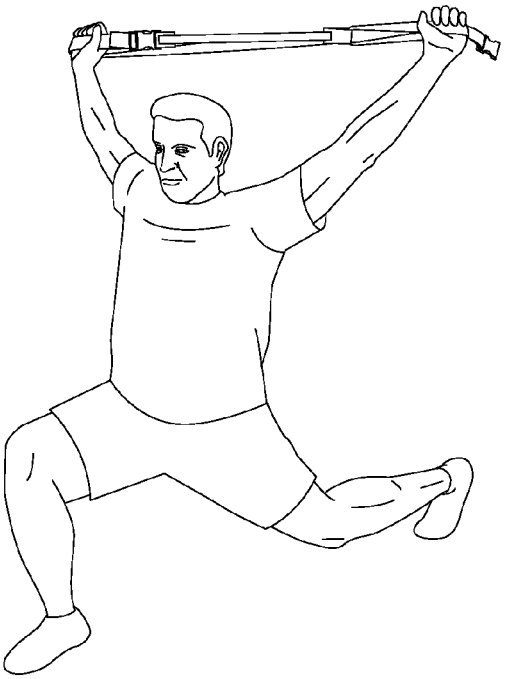
FIG. 8 illustrates the device in use as worn by a person in a shoulder/upper body lunge stretching position, according to an embodiment of the present invention.
Figure 9:
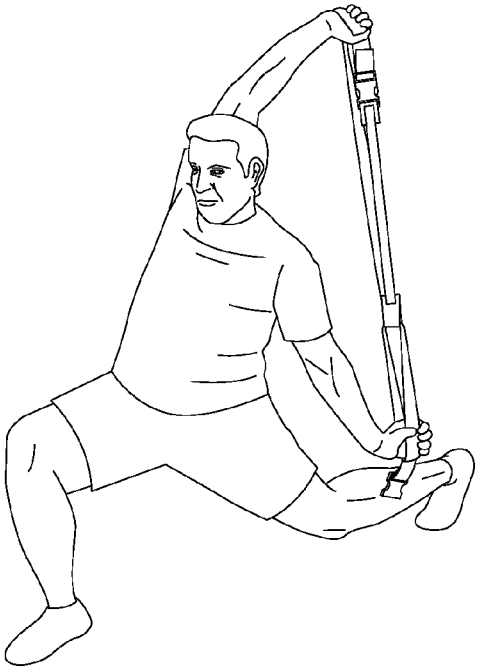
FIG. 9 illustrates the device in use as worn by a person in another shoulder/upper body lunge stretching position, according to an embodiment of the present invention.

As illustrated in FIG. 8 and FIG. 9, the device is illustrated in use in a lunge position. Two particular stretching exercises may be performed using the device. As shown in FIG. 8 the user is in a lunge with the device held taut above the head with elbows locked and stretching is performed in a vertical side-to-side motion over the head. As shown in FIG. 9 the left side stretch is conducted and similarly, the user will continuously move vertically to the right side stretch. This stretching motion is repeated a number of times and further repeated in the left leg lunge position. The second type of lunge stretch exercise, (not shown), is also conducted while in the lunge position, where the device is used in front of the body in a horizontal side to side stretching with the elbows locked. Similarly, the exercise is repeated in both the right and left leg lunge positions.

Figure 10:
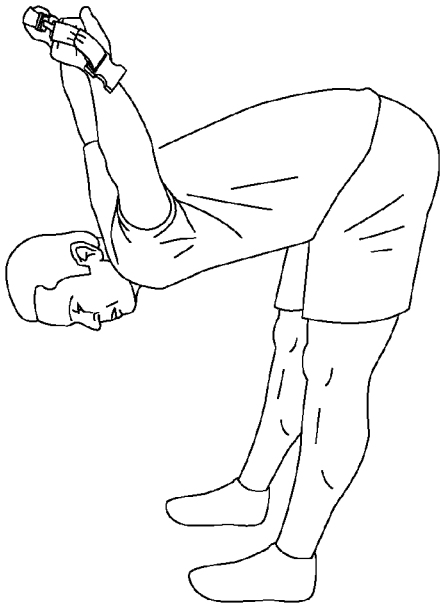
FIG. 10 illustrates the device in use as worn by a person in another shoulder/upper body bent stretching position, according to an embodiment of the present invention.
Figure 11:
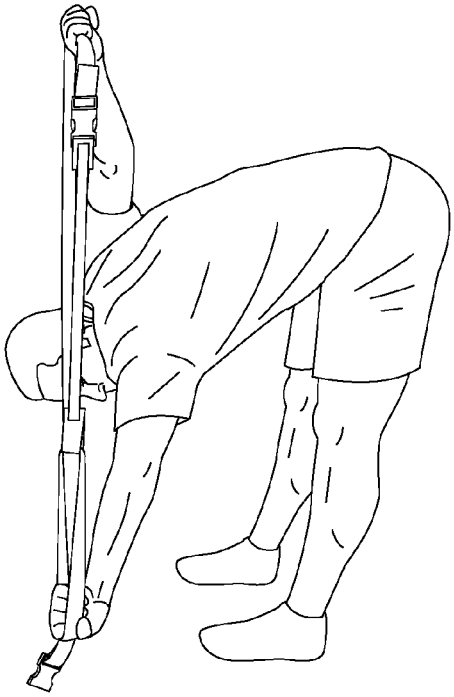
FIG. 11 illustrates the device in use as worn by a person in another shoulder/upper body bent stretching position, according to an embodiment of the present invention.

As further shown in FIGS. 10-11, the device is used in a standing bent over position with the device straps in a taut positions. With elbows locked, and knees locked, the user holds the device behind and over the head and rotates in a side-to-side motion. Accordingly, the device is easily disassembled to conduct such shoulder/upper body exercises and then reassembled to conduct the supine position exercises, and vice versa.

Similarly as with the extension strap 22, the central hold 13 may include measure markings to measure how tightly the central hold is pulled through an adjuster so as to accommodate the span of the arms of different sized users. In an embodiment, the measured marks may be in half-inch increments for example. As a user increases in flexibility through the shoulders, the length of the central hold may be shortened gradually, either during a session of stretching exercises or in general.

The versatility of the device is supported by the quick release mechanisms and adjustability of the straps. The device is useful in a variety of stretching, muscle strengthening and range of motion exercises, in a lightweight, sturdy, convenient and comfortable manner.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description.

What is claimed is:

1. A device for increased range of motion and hands free stretching, the device comprising:

a body harness including at least one shoulder support strap and an adjustable length central strap for arranging around an upper torso of a body;

at least one movable segment attached to and slidable along a length of the central strap;

at least one adjustable length extension strap having a first end secured to the movable segment and a distal end forming a looped support, the adjustable extension strap having a length to accommodate different heights of users, and a plurality of incremental markings located along a surface of the adjustable extension strap, wherein the markings identify the length of the strap between the first end and the looped support, and the extension strap is formed of a flexible and non-elastic material; and a strap adjuster located separate from the looped support on the extension strap between the first end and before the looped support formed by the distal end begins on the adjustable extension strap, the length of the extension strap after the first end and before the looped support begins being adjustable through the strap adjuster, and the strap adjuster configured to mark an amount of adjustment by positioning the strap adjuster at the desired incremental marking on the surface of the adjustable extension strap;

wherein the adjustable extension strap is movable relative to the movable segment, hands free, along the length of the central strap.

2. The device of claim 1, wherein each of the straps comprise a flexible, non-elastic material.

3. The device of claim 1, wherein the body harness comprises two shoulder support straps.

4. The device of claim 1, wherein the movable segment is an O-ring.

5. The device of claim 1, wherein the movable segment is removably attached.

6. The device of claim 1, wherein the movable segment is selected from the group consisting of a clip, a hook, and a carabiner.

7. The device of claim 1, wherein the movable segment is a loop formed by the first end of the extension strap connecting around the central strap.

8. The device of claim 1, wherein the central strap comprises a connector assembly for easy removal of the harness.

9. The device of claim 8, wherein the connector assembly comprises a buckle connection.

10. The device of claim 1, wherein the central strap comprises a strap adjuster.

11. The device of claim 10, wherein each strap adjuster includes a buckle connection.

12. The device of claim 1, wherein the strap adjuster of the extension strap includes a quick release connection such that the distal end support of the extension strap is removable from the first end of the strap, dividing the extension strap into two separate parts.

13. The device of claim 1, wherein the shoulder strap comprises a quick release connection assembly.

14. The device of claim 1, wherein the shoulder strap comprises a strap adjuster.

15. A method of using a device for hands free stretching, the device comprising a body harness including an adjustable central strap; at least one adjustable length non-elastic extension strap having a first end and a second end, the first end slidably attached to and extending from the central strap to move independently of the central strap along a transverse length of the central strap, and the second end forming a looped appendage support; and a strap adjuster located on the extension strap, separate from the looped appendage support, the method comprising:

arranging the harness over at least one shoulder and the central strap around an upper torso of a body, the central strap positioned transversely across a front of the upper torso;

placing a foot into the support formed at the second end of the extension strap;

adjusting a length of the extension strap through the strap adjuster to a desired length for stretching; and applying tension against the support to perform hands free stretching.

16. The method of using a device for hands free stretching according to claim 15, wherein prior to applying tension against the support, the user lying in a supine position;

applying tension against the support, with the foot; and maintaining the extension strap taught while rotating a leg of the foot in a transverse direction to slide the first end of the extension strap along the central strap in the transverse direction.

17. The method according to claim 15, wherein the adjustable length extension strap further comprises a plurality of incremental markings, and the adjusting step further comprises moving the extension strap through the strap adjuster and using the plurality of incremental marks to identify the desired length.

* * * * *